United States Patent [19]

Kataoka et al.

[11] Patent Number: 4,723,523

[45] Date of Patent: Feb. 9, 1988

[54] AIR/FUEL RATIO CONTROL SYSTEM FOR INTERNAL COMBUSTION ENGINE

[75] Inventors: Masahiro Kataoka; Masakazu Ninomiya; Norio Omori, all of Kariya, Japan

[73] Assignee: Nippondenso Co., Ltd., Kariya, Japan

[21] Appl. No.: 936,108

[22] Filed: Nov. 28, 1986

[30] Foreign Application Priority Data

Dec. 2, 1985 [JP] Japan ..... 60-270905

[51] Int. Cl.[4] ..... F02D 41/06

[52] U.S. Cl. ..... 123/491; 123/179 L

[58] Field of Search ..... 123/491, 179 G, 179 L

[56] References Cited

U.S. PATENT DOCUMENTS 4,462,375 7/1984 Isobe et al. ..... 123/491
4,469,072 9/1984 Kobayashi et al. ..... 123/491
4,508,077 4/1985 Shimbara ..... 123/357
4,528,963 7/1985 Bessho et al. ..... 123/491
4,543,937 10/1985 Amano et al. .

FOREIGN PATENT DOCUMENTS 134335 8/1984 Japan .

*Primary Examiner*—Tony M. Argenbright
*Attorney, Agent, or Firm*—Cushman, Darby & Cushman

[57] ABSTRACT

An air/fuel ratio control system for an internal combustion engine that compensates, the amount of fuel supplied at engine starting based on lapsed time since the engine was operated and stopped. A lapse time from the immediately previous engine stop to the subsequent engine start is determined. Based on this lapse time, an increase value of fuel to be supplied into the engine's intake air by fuel injection valves is determined. This increase value is determined according to a pre-established of fuel temperature. The fuel supply amount is corrected upon engine start on the basis of the increase value.

9 Claims, 9 Drawing Figures

(INCREASE CORRECTION ROUTINE)

(LAPSE TIME CALCULATING ROUTINE (INCREASE CORRECTION ROUTINE)

FIG. 8
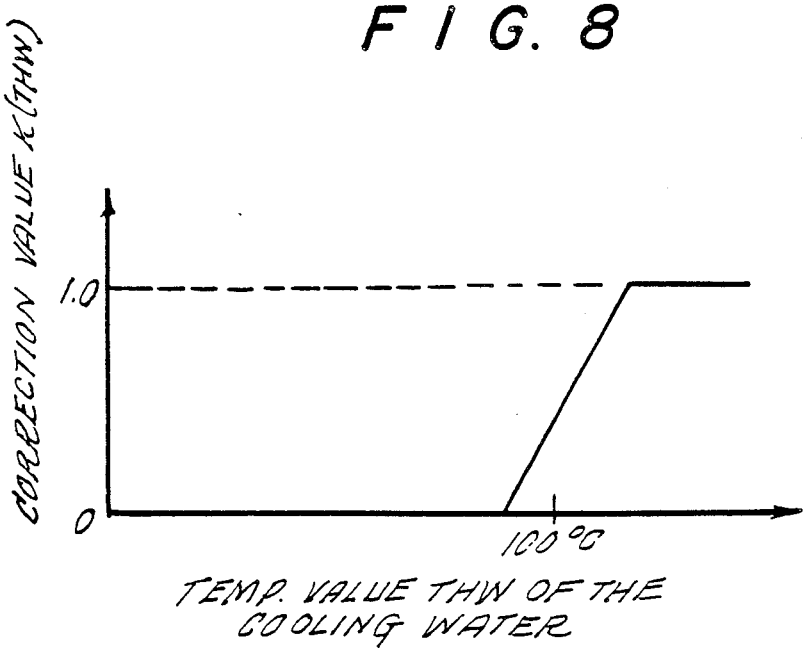
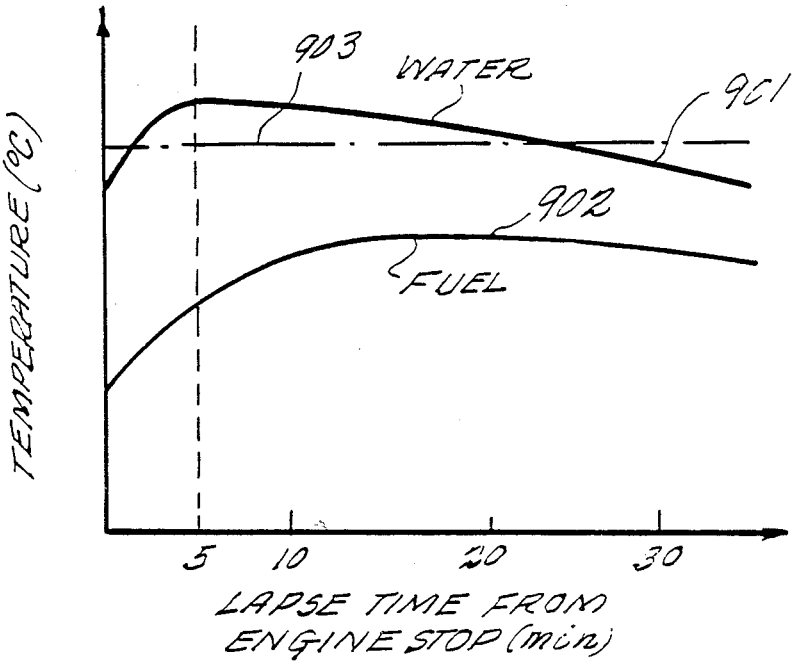
FIG. 9

AIR/FUEL RATIO CONTROL SYSTEM FOR INTERNAL COMBUSTION ENGINE

BACKGROUND OF THE INVENTION

The present invention relates to an air/fuel ratio control system for an internal combustion engine. More particularly, the invention provides an air/fuel ratio control system for an internal combustion engine, which enables the internal combustion engine to be started at an optimum air/fuel ratio by controlling the amount of fuel injected at each fuel injection when the engine is in the process of being started.

It is known to control air/fuel ratio according to various engine operating parameters so as to run the engine under an optimum condition. The same control of the fuel supply amount for each injection carried out during normal running of the vehicle is also carried out when the engine is in the process of being started. The injection time of a fuel injector is suitably set to provide fuel to the engine at a rate according to the starting characteristics of the engine. However, there is a problem in using the "normal" air/fuel ratio controlling techniques during engine starting.

Systems which determine the amount of a fuel to be supplied to the engine in proportion to the injection time of the fuel injector do not operate properly when the engine is being started "hot" (i.e. the engine was recently operated and turned off). Under a "hot" start condition the actual amount of fuel supplied to the engine is reduced from the amount it should be because some of the fuel is vaporized by the heat of the engine. The amount of fuel is reduced by a rate at which fuel vapor is being generated. For a given injection time the air/fuel ratio becomes leaner than desired. This will occur when the engine is heated to a high temperature after a high-load run over a long time. This phenomenon is particularly likely to occur when the engine is started "hot". The engine may fail to be supplied with a sufficient amount of fuel thereby making the engine difficult, if not impossible to start.

As disclosed in Japanese Pre-Examination Patent Publication No. 59-134335, there has been proposed a system for increasing the injection amount of the fuel (over and above the amount that would otherwise have been injected) at the start of the engine when the engine is in its state of high cooling water temperature, by detecting not the fuel temperature but the cooling water temperature.

However, even the proposed system does not completely solve the problem. As seen in the Figure 9 graph, fuel temperature in the injector (indicated by reference numeral 902) which is plotted against time lapse from an engine stop, is not identical to cooling water temperature (indicated by reference numeral 901) plotted against time lapse from engine stop. It is, therefore, not always effective to simply increase the fuel supply rate when the cooling water temperature exceeds some predetermined judgment level (indicated by reference numeral 903), as in the prior art system.

With continued reference to FIG. 9, consider the case in which five minutes have elapsed after engine stop. Although fuel temperature in the injector is not so high at 60° C., cooling water temperature exceeds judgment level 903 so that the fuel supply amount is increased. This causes a problem in that the fuel supply amount is increased even for a small amount of fuel vapor generated so that the air/fuel mixture is abnormally enriched, which deteriorates fuel consumption rate and exhaust emissions. Consider another case in which thirty or more minutes have elapsed after engine stop. Although the cooling water temperature is below judgment level 903 so that there will be no fuel supply increase, vapor lock may occur because the fuel temperature is still high. The proposed system would compensate by leaning the air/fuel ratio which would make it more difficult to start the engine.

SUMMARY OF THE INVENTION

The present invention solves this problem of "improper" correction by providing an air/fuel ratio control system for an internal combustion engine, which properly corrects the fuel supply amount while the fuel vapor is being generated, to improve not only the starting characteristics but also the fuel consumption rate and the exhaust emission by carrying out correction of the fuel supplying rate according to the fuel temperature in a fuel pipe during a hot start.

As exemplified in the basic construction of the invention shown in FIG. 1, there is provided an air/fuel ratio control system for an internal combustion engine having the following main elements.

A basic fuel injection calculating means Mb calculates a basic amount of fuel corresponding to conditions of said engine detected by condition detecting means M5. Lapse time calculating means M2 calculates a lapse time from the immediately previous stop to the subsequent start of the engine M1. An increasing value setting means M3 sets an increasing value by using the lapse time calculated by the lapse time calculating means M2. Correcting means M4 increases and corrects the basic amount of fuel upon engine start on the basis of the increasing value set by the increasing value setting means M3.

Lapse time calculating means M2 calculates the lapse time from the immediately previous stop of the engine M1 to the subsequent engine start. Calculating means M2 could be implemented by a timer built in a microcomputer in accordance with, the arithmetic processing procedures of a CPU or a lapse time arithmetic operation circuit separate from the CPU, or some other device. For example, lapse time calculating means M2 may also be constructed to calculate the lapse time by reading the stop time of the engine M1 from a vehicle clock and storing the read time in a backed-up RAM of the microcomputer, by reading out the subsequent start time and by calculating the difference as that lapse time.

The increasing value setting means M3 sets the fuel increasing value based on the lapse time calculated by the lapse time calculating means M2, according to a predetermined relationship among lapse time, increasing value, and fuel temperature. The relationship between the lapse time and the fuel temperature is exemplified by the curve 902 of the graph of FIG. 9, as previously discussed.

Correcting means M4 increases and corrects the basic fuel calculated by the basic fuel injection calculating means M5 at the start of the engine on the basis of the increasing value set by increasing value setting means M3. After the engine has been started, the increasing value may be continued for a predetermined time or attenuated at a constant changing rate with time or in accordance with cooling water temperature. The increasing value of the fuel supplying amount may be corrected in terms of the temperature value of the cooling water such that the increase of the fuel supplying amount is determined by multiplying, adding or subtracting the corrected value of the cooling water temperature.

The aforementioned increasing value setting means M3 and correcting means M4 are preferably, but not necessarily, constructed as a logical arithmetic circuit having a built-in microcomputer, for example, so as to control in accordance with the processing (arithmetic) procedures which have been stored in a ROM or the like.

The operation of the invention will now be described. The increasing value setting means M3 provides the "increasing value" based on an elapsed time provided by lapse time calculating means M2 using a predetermined relationship. A signal indicative of the thus determined "increasing value" is coupled to correcting means M4. Correcting means M4 increases and corrects the basic fuel amount at the start of the engine on the basis of the aforementioned increasing value so that it can properly correct the fuel supply rate when conditions are such that would cause fuel vapor to be generated the engine is started.

BRIEF DESCRIPTION OF THE DRAWINGS

FIG. 2 is a schematic diagram showing portions of an internal combustion engine and associated devices.

FIG. 3 is a block diagram of the electronic control circuit and associated devices.

FIG. 4 is a flow chart showing the lapse time calculating routine carried out by the electronic control circuit.

FIG. 5 is a flow chart of the increasing and correcting routine carried out by the electronic control circuit.

FIG. 6 is a graph of the relationship between the value of the counter CST and correction value.

FIGS. 7 and 8 show a second embodiment of the invention.

FIG. 7 is a flow chart of the increasing and correcting routine carried out upon a "hot" start by the electronic control circuit.

FIG. 8 is a graph showing the relationship between cooling water temperature and correction value of the fuel increase rate of the internal combustion engine.

FIG. 9 is a graph showing the changes of the fuel temperature and cooling water temperature as a function of lapse time after engine stop.

DETAILED DESCRIPTION OF THE PREFERRED EMBODIMENTS

A first embodiment of the present invention will be described with reference to FIGS. 2–6.

Figure 1:
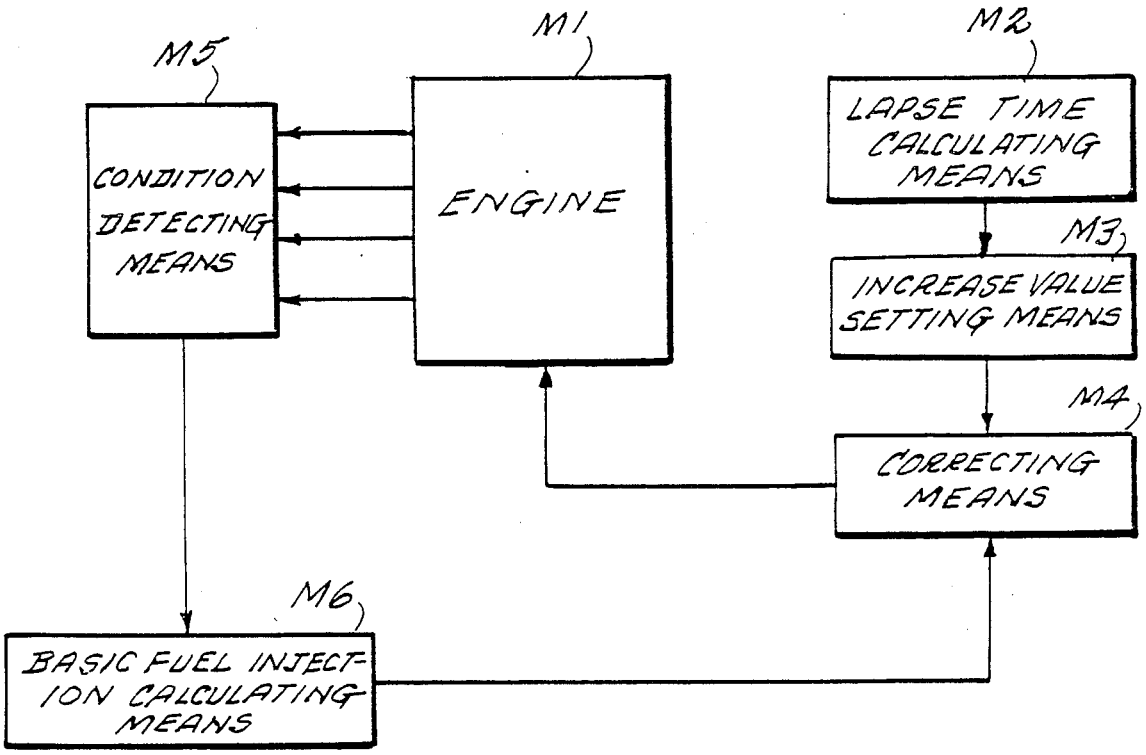
FIG. 1 is a general block diagram of the invention.
Figure 2:
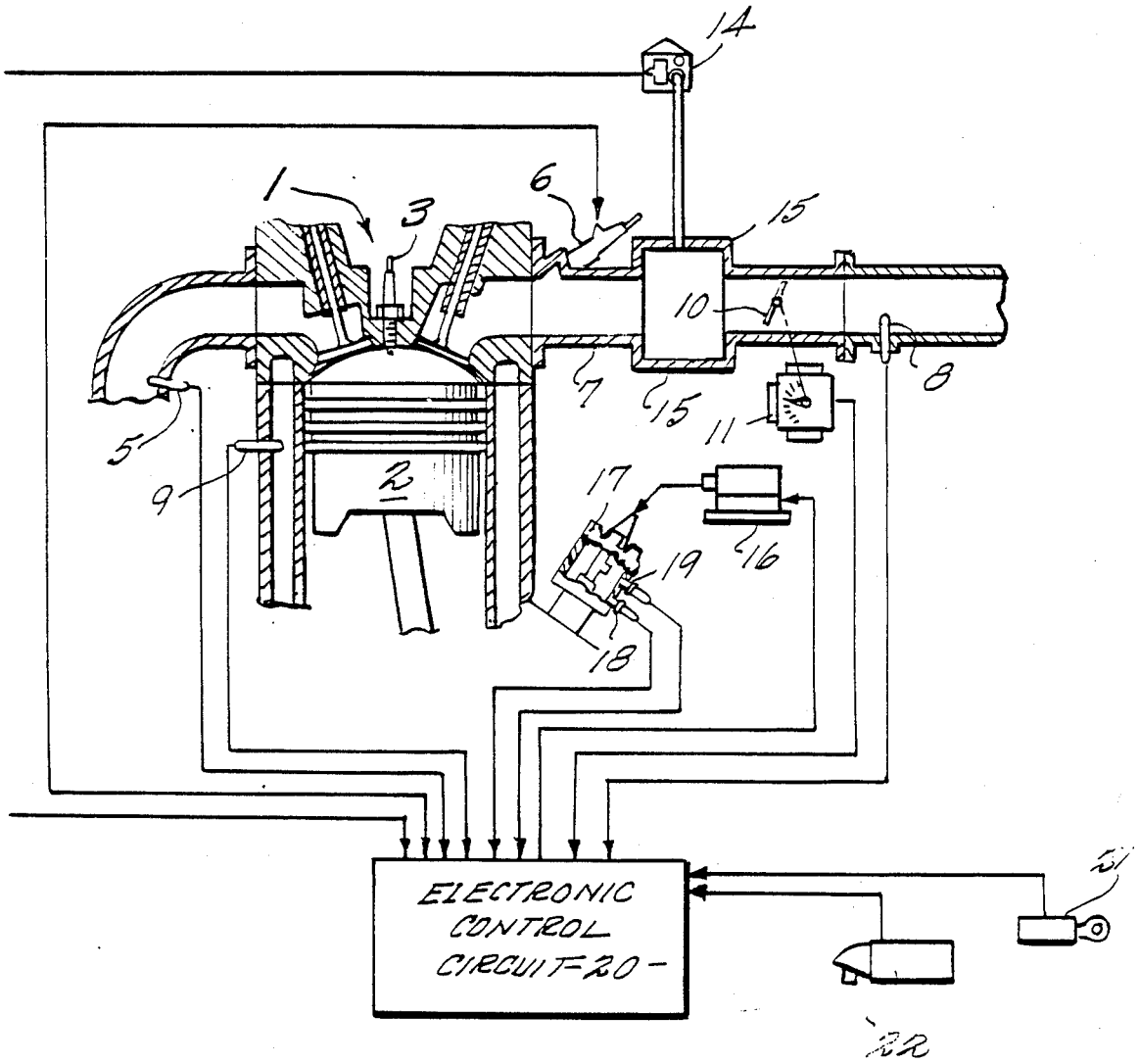
FIGS. 2 to 6 show a first embodiment of the present invention.

FIG. 2 is a schematic diagram showing various elements of an internal combustion engine, to which an air/fuel ratio control system according to the present embodiment is applied.

The engine includes an engine body 1, a piston 2, an ignition plug 3, an exhaust manifold 4, an oxygen sensor 5 attached to exhaust manifold 4 for detecting the concentration of oxygen in an engine exhaust gas, a fuel injection valve 6 for injecting fuel into the engine's intake air, an intake manifold 7, an intake temperature sensor 8 for detecting intake air temperature, a water temperature sensor 9 for detecting engine cooling water temperature, a throttle valve 10 for controlling intake air flow rate, a throttle open degree sensor 11 associated with throttle valve 10 for detecting the open degree of throttle valve 10 and provide a signal indicative thereof, and an intake pressure sensor 14 for measuring the intake pressure in a surge tank 15 for absorbing the pulsations of the intake air.

An igniter 16 provides a high voltage necessary for ignition. A distributor 17, associated with a crankshaft (not shown), distributes the high voltage provided by 16 to ignition plugs 3 of respective cylinders. A revolution angle sensor 18, associated with distributor 17 acts as an r.p.m. sensor for outputting twenty four pulses of a pulse signal for each revolution of distributor 17, i.e., every two revolutions. A cylinder discriminating sensor 19 outputs one pulse for each rotation of distributor 17. An electronic control circuit 20 receives signals from the various sensors and provides signals as will be discussed below. A key switch 21 and a starter motor 22 start the engine. Starter reactor 22 provides a signal indicative of the revolving state of the starter at a predetermined time interval.

Figure 3:
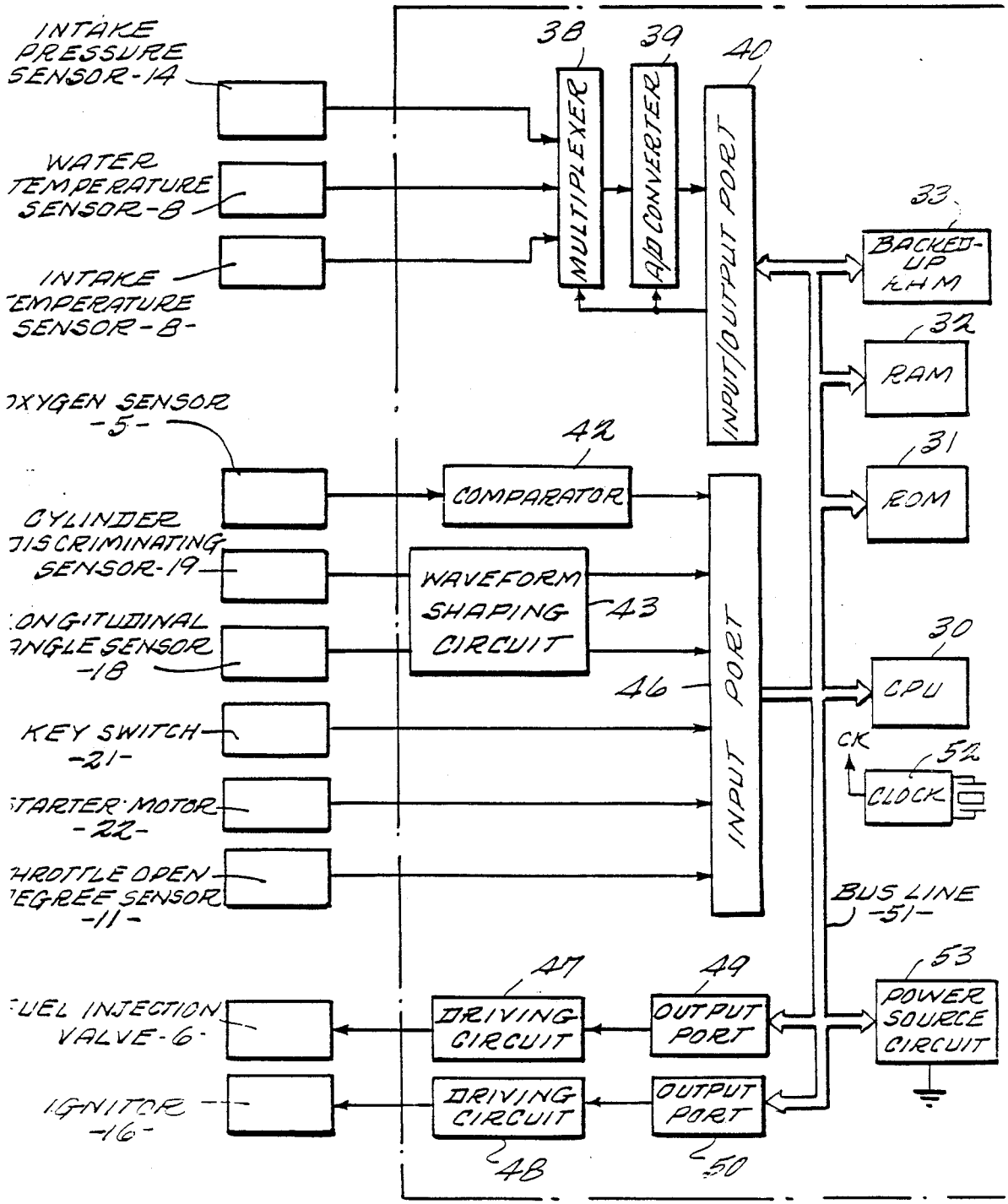

FIG. 3 is a block diagram of electronic control circuit 20 and various of its associated units.

A central processing unit (CPU) 30 receives data from the various sensors, arithmetically operates on the received data in accordance with a control program and executes processings for operating and controlling the various units. A read only memory (ROM) 31 has stored therein control programs and initial data. A random access memory (RAM) 32 temporarily reads and writes data inputted to the electronic control circuit 20 and the data necessary for the arithmetic control. A backed-up random access memory (RAM) 33 acts as a non-volatile memory backed up by a battery so that, even when key switch 21 is turned OFF, the data necessary for the subsequent engine operations is maintained. A multiplexer 38 selectively outputs the signals from the individual sensors to CPU 30.

An A/D converter 39 converts an analog signal from multiplexer 38 to a digital signal. An input/output port 40 sends individual sensor signals to CPU 30 via multiplexer 38 and A/D converter 39 and provides control signals initiated by CPU 30 for operating multiplexer 38 and A/D converter 39.

A comparator 42 compares the output signal from oxygen sensor 5 with predetermined criteria. A waveform shaping circuit 43 shapes the waveforms of the output signals of revolutional angle sensor 18 and cylinder discriminating sensor 19. The output of throttle open degree sensor 11, the operation signal of the key switch 21, and the output signal of the starter motor 22 are sent via an input port 46 to CPU 30.

Driving circuits 47 and 48 drive fuel injection valve 6 and igniter 16, respectively in response to the signals from CPU 30 via output ports 49 and 50, respectively. A bus line 51 provides paths for signals and data. A clock circuit 52 provides a clock signal CK for controlling the timing of CPU 30, ROM 31 and RAM 32 in accordance with a predetermined time interval. A power source circuit 53 supplies the main power to the aforementioned individual units even after key switch 21 has been turned OFF. Power source circuit 53 stops the supply of power in response to a stop signal from CPU 30.

The operations of electronic control circuit 20 will now be described. Upon engine start, CPU 30 receives through input/output port 40 data indicative of intake air temperature, as detected by the intake temperature sensor 8, and cooling water temperature, as detected by water temperature sensor 9. CPU 30 calculates a basic fuel injection amount for Tp engine start from those data. This basic fuel injection amount Tp is corrected by increase correction processing (to be described) to calculate the actual fuel injection amount to be used at engine start. Thereafter, fuel supply is set by fuel injection valve 6 on the basis of that actual fuel injection amount.

After engine start, the following operations are conducted as the ordinary fuel supply system which is described in detail in the U.S. Pat. No. 4,543,937. The information contained in U.S Pat. No. 4,543,937 is hereby incorporated by reference as if fully set forth herein.

At first, CPU 30 receives via input/output port 40 and input port 46 data indicative of both intake pressure, as detected by the intake pressure sensor 14, and engine r.p.m., as detected by revolution angle sensor 18, and calculates the basic fuel injection amount Tp from those data. Then, this basic fuel injection amount Tp is corrected in accordance with both intake temperature, as detected by the intake temperature sensor 8 and the cooling water temperature, as detected by water temperature sensor 9 and further in accordance with the residual oxygen concentration in the exhaust gas detected by oxygen sensor 5. On the basis of this corrected fuel injection amount, fuel injection valve 6 is controlled to effect a "normal" running state of engine 1.

The processing steps carried out by electronic control circuit 20 will be described with reference to FIGS. 4 and 5.

Figure 4:
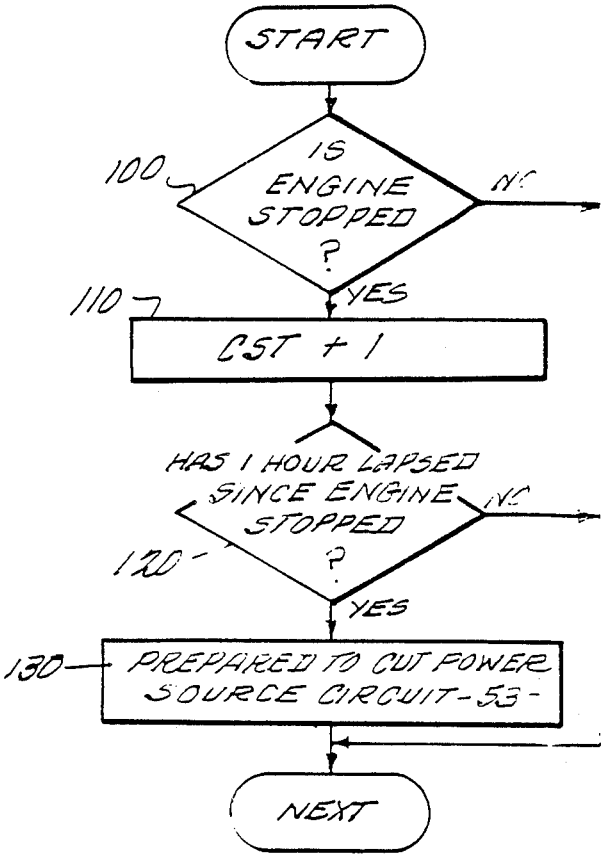
Figure 6:
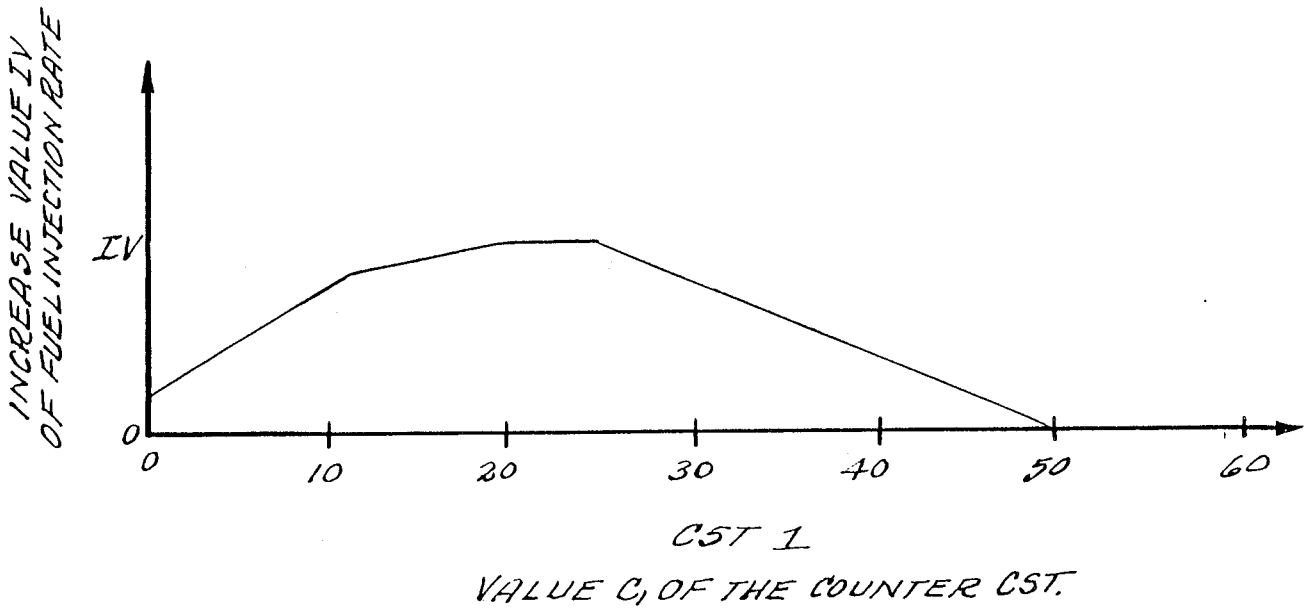

FIG. 4 is a flow chart showing a lapse time calculating routine for calculating the lapse time from an engine stop to the next start and shows the processing to be executed at a constant interval, e.g., for every one minute.

First, it is judged at a step 100 whether or not engine 1 is stopped. This is determined by looking at a key-OFF signal from key switch 21. If the result of step 100 is "NO", namely, if engine 1 is not stopped, the remaining steps of the lapse time calculating routine shown in FIG. 4 are bypassed by going directly to the "NEXT" block at the bottom of the Figure.

If, however, step 100 results in a "YES" i.e. engine 1 is stopped, control flows to a subsequent step 110. At step 110, a counter CST is incremented on the basis of the signal of clock 52. Incidentally, the value of this counter CST is stored in the backed-up RAM 33. At a subsequent step 120, it is judged whether or not a certain time, e.g., one hour in the present embodiment has elapsed since the last engine stop on the basis of the value of the counter CST. If "NO" at the step 120, the remaining steps are bypassed and control passes directly to the "NEXT" block.

If "YES" at the step 120, namely, if one hour has elapsed since the last engine stop control passes to a subsequent step 130. At step 130, power source circuit 53 of electronic control circuit 20 is shut-off. For example, after the timer has "timed out" by the passage of a predetermined time such as, for example, one hour (i.e., the time required for terminating the present routine after the step 130), a stop signal for stopping power is sent by CPU 30 to power source circuit 53. Subsequently, the processings pass through the present routine to the "NEXT".

Counter CST is incremented at one minute intervals after an engine stop and continues to be incremented until sixty minutes have elapsed after the stop, after which electronic control circuit 20 is turned off.

The process of increasing and correcting the fuel supply amount for a hot start, will now be described. FIG. 5 is a flow chart showing the increase correction routine for a hot start and shows the steps carried out each time the output signal from starter motor 22 is inputted to input port 46.

Figure 5:
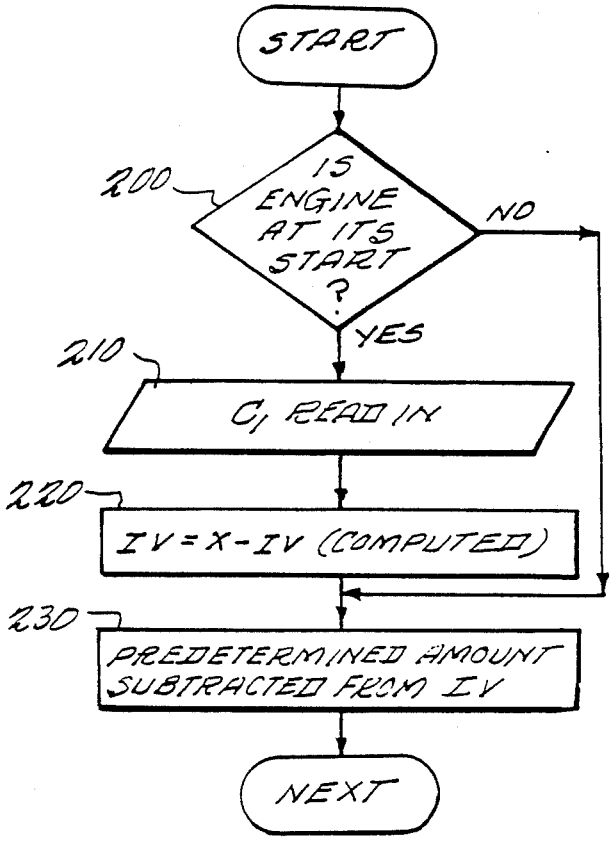

If the FIG. 5 routine is initiated, it is judged at a step 200 whether or not internal combustion engine 1 is starting. This is determined based upon whether or not the starter is turning, by reading the output signal of starter motor 22. If "YES" at the step 200, namely, if engine 1 is starting, control proceeds to a subsequent step 210. At this step 210, the value Ci of counter CST in the aforementioned lapse time calculating routine is read from backup RAM 33. At a subsequent step 220, the increase value IV of the fuel injection amount is computed on the basis of the value $C_1$ of the counter CST and the read at the foregoing step 210. This computation is conducted by using a "look-up" table stored in ROM 31 which is based on the relationship between the value $C_1$ of the counter CST and the increase value IV of FIG. 6, for example. At a subsequent step 230, a predetermined value is subtracted from the increase value IV calculated at the foregoing step 220. Subsequently, the control passes through the present routine to the "NEXT".

If "NO" at the step 200, namely, if the engine is not being started, control passes to step 230, at which the aforementioned increase value IV of the fuel injection amount has a predetermined amount subtracted from it and control then passes to "NEXT". In short, after engine start, each time the step 200 judges "NO" so that step 230 is processed, the aforementioned increase value IV is attenuated until it is finally reduced to zero. Incidentally, when the increase value IV becomes zero, counter CST is cleared to zero at a not-shown step in the present routine.

The increase value of the fuel injection amount thus determined is used as the correction value of the basic fuel injection amount upon engine start and thereafter in such a manner that actual injection amount T is calculated as $T = Tp\ (HIVAK_1 + \text{--} tKn)$, where $K_1$, --, Kn are other correction factors.

By determining the increase value of the fuel injection amount in accordance with the lapse time from an engine stop to the next start, the increase value of the fuel injection amount according to the temperature of the fuel in the fuel pipe of engine 1 can be attained to make the correction of the fuel supplying amount proper when the vapor is generated. This improves the starting characteristics of engine 1 and prevents the air/fuel ratio from becoming abnormally rich to improve the fuel consumption rate and exhaust emission.

Figure 7:
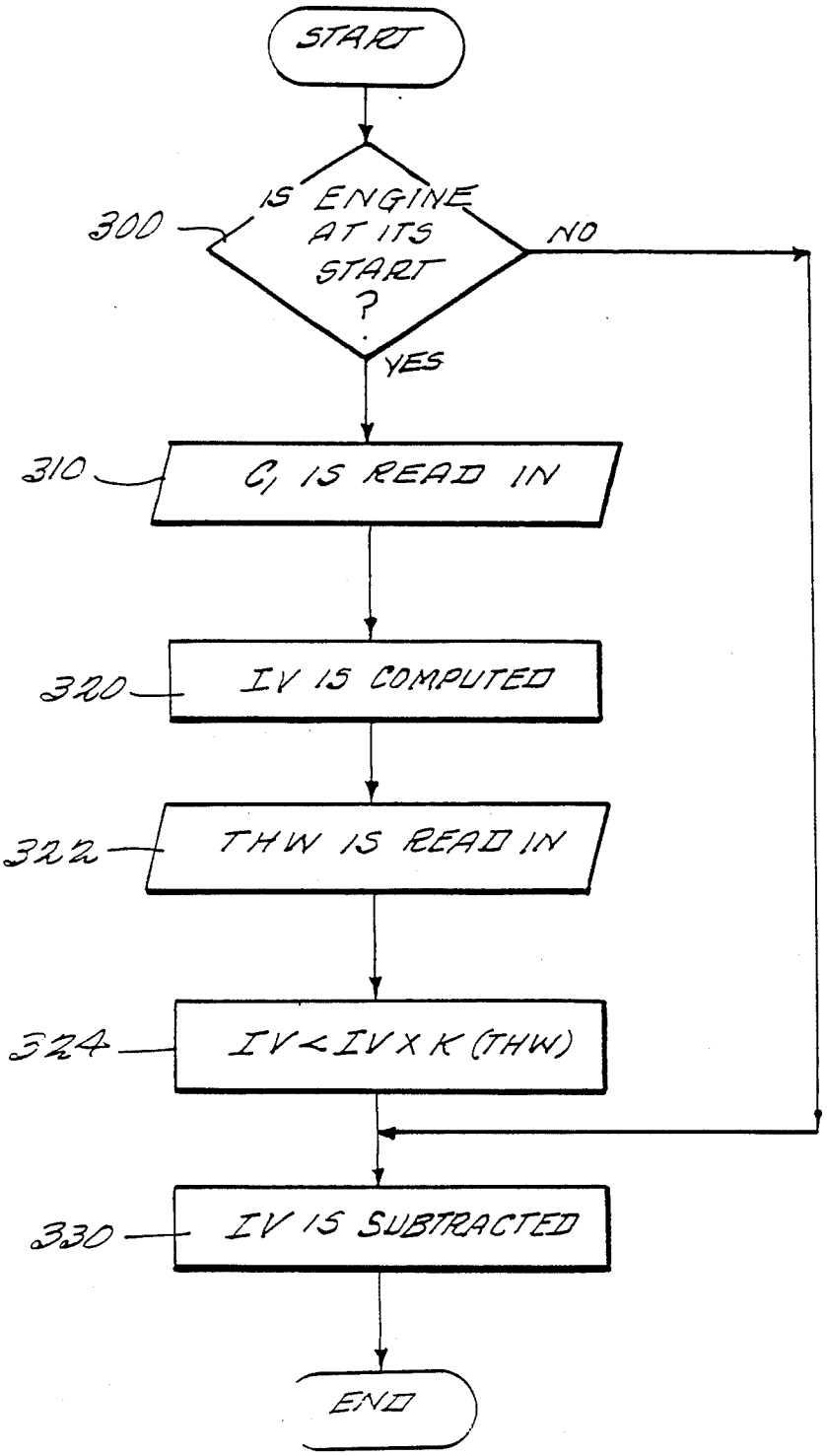

A second embodiment of the present invention will now be described with reference to FIGS. 7 and 8. This second embodiment is identical to the first embodiment in the construction of the internal combustion engine and its peripheral units and the lapse time calculating routine to be executed by the electronic control circuit 20. Therefore, these elements will not be described. The difference between the two embodiments resides in the increase correcting routine for a hot start, the steps of which are shown in FIG. 7. Steps 300, 310, 320 and 330 are identical to corresponding steps 200, 210, 220 and 230 of the first embodiment, respectively. At step 300, it is judged that the engine is at the start. Then, the value $C_1$ of the counter CST is read in at the step 310, and the increase value IV of the fuel injection amount is computed step 320. At a subsequent step 322, the temperature value THW, of the cooling water is read by looking at the detection signal of water temperature sensor 9. At a subsequent step 324, correction value K (THW) is calculated on the basis of the cooling water temperature value read in the foregoing step 322 and is multiplied by the increase value IV of the fuel injection amount calculated at the foregoing step 322 to set a new increase value IV of the fuel injection amount. The calculation of the aforementioned correction value K(THW) is made in accordance with the graph of FIG. 8 showing the relationship between cooling water temperature THW and the correction value K(THW), for example. Subsequently, control flows to step 330, at which that calculated increase value IV of the fuel injection amount is subtracted by a predetermined value, after which control passes to "NEXT".

If "NO" at the step 300, on the contrary, flow proceeds to step 330 to attenuate the aforementioned increase value IV. These steps are repeated until the aforementioned increase value IV becomes zero, and counter CST is cleared to zero at a not-shown step.

As has been described hereinbefore, the second embodiment of the present invention has, as in the first embodiment, improves not only the starting characteristics but also the fuel consumption rate and in accordance with the lapse time from the stop to the start of the engine. As a result, the increase value of the fuel supplying amount can be obtained in accordance with fuel temperature in the fuel pipe at the start of the engine, and the correction of the fuel supplying amount when the fuel vapor is generated can be made properly. Thus, it is possible to improve the starting characteristics of the engine and to prevent the air/fuel ratio from becoming abnormally rich thereby to improve the fuel consumption and the exhaust emission.

What is claimed is:

1. An air/fuel ratio control system for an internal combustion engine, comprising:

basic fuel injection calculating means for calculating a basic amount of fuel corresponding to conditions of said engine;

lapse time calculating means for calculating a lapse time from an engine stop to a subsequent engine start;

increase value setting means for indicating, based on said lapse time, an increase value corresponding to an amount by which fuel injection should be increased there having been pre-established a relationship between said increase value and lapse time based on a measured relationship between fuel temperature and time lapse from an engine stop; and correcting means for increasing and correcting said basic amount of fuel that, in the absence of said increase value setting means, would have been supplied at the start of said engine, on the basis of said increase value.

2. A system according to claim 1, wherein said lapse time calculating means comprises;

engine stop detecting means for detecting an engine stop;

counting means for counting a time from the engine stop detected by said engine stop detecting means; and time storing means for storing the time counted by said counting means as said lapse time.

3. A system according to claim 1, wherein said lapse time calculating means comprises;

a watch designating a time for an operator;

first reading means for reading a time of an engine stop by using said watch, and storing the time of the engine stop;

second reading means for reading a time of an engine start by using said watch; and means for calculating said lapse time by subtracting the time of the engine stop stored in said first reading means from the time of the engine start read by said second reading means.

4. A system according to claim 1, wherein said increase value setting means comprises memory means storing a plurality of increase value along with corresponding lapse times therein;

increase value looking up means for looking up said increase value in said memory means according to said lapse time calculated by said lapse time calculating means from said memory means.

5. A system according to claim 1, further comprising means for increasing and correcting said basic amount of fuel after the start of said engine for a predetermined time on the basis of said increase value set by said increase value setting means.

6. A system according to claim 1, further comprising means for increasing and correcting said basic amount of a fuel after the start of said engine on the basis of an auxiliary increase value which is attenuated from said increase value by constant rate.

7. A system according to claim 1, further comprising cooling water temperature detector for detecting a cooling water temperature; and increase value correcting means for correcting said increase value set by said increase value setting means on the basis of said cooling water temperature.

8. A system according to claim 7, wherein said increase value correcting means controls said increase value to zero when said cooling water temperature is smaller than a predetermined temperature.

9. A system according to claim 1, further comprising intake air temperature detector for detecting an intake air temperature; and increase value correcting means for correcting said increase value set by said increase value setting means on the basis of said intake air temperature.

* * * * *